US005443016A

United States Patent [19]

Erickson

[11] Patent Number: 5,443,016

[45] Date of Patent: Aug. 22, 1995

[54] CONVERTIBLE HOPPER RAILCAR DESIGN WITH INTERNAL BRACING FOR ADAPTING CAR TO HAUL BLADDERS

[75] Inventor: Stewart Erickson, Ketchum, Id.

[73] Assignee: SEEC, Inc., Menota Heights, Minn.

[21] Appl. No.: 301,224

[22] Filed: Sep. 6, 1994

Related U.S. Application Data

[63] Continuation of Ser. No. 66,684, May 24, 1993, abandoned.

[51] Int. Cl.[6] ..... B61D 7/02; B61D 17/00

[52] U.S. Cl. ..... 105/411; 105/248; 105/359; 105/404; 410/54

[58] Field of Search ..... 105/243, 247, 248, 358, 105/359, 377, 404, 406.1, 41.1; 410/54; 414/498, 679, 347, 399, 391; 222/105, 181

[56] References Cited

U.S. PATENT DOCUMENTS

| | | | |
|---|---|---|---|
| 2,293,160 | 8/1942 | Miller et al. | 105/248 |
| 2,712,797 | 7/1955 | Woehrle et al. | 296/39.1 |
| 2,853,960 | 9/1958 | Corrigan | 105/248 |
| 2,875,562 | 3/1959 | Mitchell | 53/434 |
| 2,931,523 | 4/1960 | Nelligan | 414/539 |
| 3,577,678 | 5/1971 | Burton . | |
| 3,806,185 | 4/1974 | Brandjord | 296/98 |
| 3,831,792 | 8/1974 | Waterman et al. | 105/377 X |
| 4,013,018 | 3/1977 | Hansen et al. | 105/468 |
| 4,079,676 | 3/1978 | Miller | 105/411 |
| 4,204,842 | 5/1980 | Morel et al. . | |
| 4,461,402 | 7/1984 | Fell et al. | 222/105 |
| 4,470,749 | 9/1984 | Koudstaal | 414/539 |
| 4,497,259 | 2/1985 | Titterton | 105/359 |
| 4,541,765 | 9/1985 | Moore | 414/267 |
| 4,557,400 | 12/1985 | Clarke | 222/105 |
| 4,579,654 | 4/1986 | Bremmer . | |
| 4,613,053 | 9/1986 | Kimura et al. . | |
| 4,664,871 | 2/1987 | Arrey et al. | 105/248 X |
| 4,670,148 | 6/1987 | Schneider . | |
| 4,678,389 | 7/1987 | Bonerb | 414/267 |
| 4,735,457 | 4/1988 | Bonerb et al. | 298/27 |
| 4,738,203 | 4/1988 | Gielow et al. | 105/406.1 |
| 4,758,344 | 7/1988 | Wildenauer . | |
| 4,823,708 | 4/1989 | Wymer et al. | 105/377 |
| 4,909,156 | 3/1990 | Erikson | 105/359 |
| 4,946,214 | 8/1990 | Neumann et al. | 105/243 X |
| 5,054,402 | 10/1991 | Brassell | 105/377 |
| 5,209,166 | 5/1993 | Tylisz et al. | 105/248 X |

FOREIGN PATENT DOCUMENTS

| | | |
|---|---|---|
| 563157 | 12/1957 | Belgium . |
| 585205 | 11/1958 | Italy . |

OTHER PUBLICATIONS

Brochure of Amfuel Fuel Cell and Coated Fabrics Company entitled "Fabribin ® Cuts Costs on Shipping-/Handling/Storage!" (1991).

Brochure of Uniroyal, "Sealdtank ®".

*Primary Examiner*—Robert J. Oberleitner
*Assistant Examiner*—S. Joseph Morano
*Attorney, Agent, or Firm*—Fredrikson & Byron

[57] ABSTRACT

The invention provides a railroad car adapted to transport bulk commodities such as coal, mineral ores, or the like yet efficiently and safely haul bladders filled with flowable commodities. The railcar includes a rugged bracing configuration which enables the railcar to readily transport bulk commodities in standard industry volumes, and within existing industry standards for material handling procedures such as flood loading of coal and rotary dumping of coal cars. The bracing configuration, floor layout, and car dimensions also permit the use of a maximum volume of bladders for effective hauling of materials in such bladders while avoiding undue wear and tear on the bladders. The bracing generally consists of at least one brace including a lower horizontal strut, an upper horizontal strut, and a generally vertical strut member. The bracing allows the railcar to handle bulk commodities such as coal while eliminating surges in bladders filed with flowable products. The utilization of the railcar is optimized, allowing for maximum volumes of materials to be readily transported in two directions as opposed to just one, thus reducing capital investment and operating costs for the railroad.

5 Claims, 4 Drawing Sheets

CONVERTIBLE HOPPER RAILCAR DESIGN WITH INTERNAL BRACING FOR ADAPTING CAR TO HAUL BLADDERS

This application is a continuation of application Ser. No. 08/066,684, filed May 24, 1993, now abandoned.

FIELD OF THE INVENTION

The invention relates to an open top railroad car adapted to transport bulk commodities such as coal, and particularly provides a railcar adapted both to haul bulk commodities and to receive bladders or the like for hauling a flowable bulk material.

BACKGROUND OF THE INVENTION

Open top hopper and open top gondola railroad cars are specifically designed to transport, load, and unload bulk commodities, such as mineral ores and coal. Such cars generally have a number of interior struts with irregular shapes and surfaces. This interior bracing provides necessary support and strength to the side walls of the railcar. Most railcars used in hauling coal and the like include a so-called center sill. This center sill is generally a stiff I-beam or the like which extends from one endwall of a railcar to the other adjacent the floor of the car, or at least from one truck of the railcar to the other.

Support bracing may extend upward from the car's floor or center sill as a plurality of paired struts which are angled toward the sidewalls away from the center sill to define a number of V-shaped supports. In other railcar designs, the braces may extend horizontally directly from one side wall of the car to the other, in which case a plurality of such struts may be staggered along the length of the railcar, with some of the braces being disposed adjacent the floor and others being carried closer to the tops of the sidewalls. In yet other railcars, some combination of these approaches is used to provide lateral strength to the side walls of the car, such as where a straight brace extends from the top of the center sill generally horizontally to both sidewalls and a V-shaped pair of supports is associated with the straight brace.

Present car designs have an interior bracing configuration which is very often extensive and staggered, giving consideration only to the physical support required by the car's side walls for transportation of the bulk commodity for which the car is intended. Railcars are generally configured within a range of overall lengths accepted in given industries to meet industry-specific loading, unloading, and volumetric requirements. In many applications, the floor is irregular. For instance, a hopper car may have a series of V-shaped depressions in the floor having sealable openings through which coal or other bulk commodities may be discharged. In some rotary dump cars, the floor includes a pair of elongate arcuate depressions, with one such depression being disposed on either side of and extending adjacent the center sill, and the endwalls of the car may meet the floor in a relatively gentle curve rather than substantially perpendicularly.

In U.S. patent application Ser. No. 910,900 filed Jul. 8, 1982 in the name of the inventor of the present invention (the teachings of which are incorporated herein by reference), a system for efficiently utilizing railcars devoted to hauling certain bulk commodities, such as coal, into dual-use railcars. This is accomplished by the use of one or more bladders in each railcar. These bladders are adapted to carry a flowable material so that one commodity (e.g. coal) can be hauled by the railcar in one direction in a standard configuration and a flowable second commodity, such as fly ash, can be hauled in the railcar on the return trip. Presently, commercially operated coal cars run in a circuit between a mine and a drop off site, such as a coal-fired power plant, and are forced to deadhead without any cargo on the return trip from the drop off site to the mine. Use of bladders as taught in U.S. patent application Ser. No. 910,900 permits a railroad operator to haul freight on the return trip by placing a different commodity in bladders and carrying those bladders in the car.

Bladders suitable for use in such an application are commercially available, such as those sold under the tradename Fabribin by the American Fuel Cell and Coated Fabrics Company. These bladders are available in a variety of sizes, ranging from relatively small capacity vessels to bladders capable of holding 20,000 pounds or more of a flowable commodity. As a railcar containing bladders filled with flowable commodities moves from one location to another, the train will generally have to vary its speed from time to time, e.g. when the train goes through a metropolitan area or travels along a curvaceous path.

This speeding up and slowing down causes the load in the railcar to be urged back and forth in the railcars under inertia. Similar forces act on the commodity in a railcar as it travels along curves in the track, when trains switch tracks and when coupling cars together. With a relatively bulky, poorly flowing material such as standard coal, the contents of the car will not tend to shift from side to side or from one end of the car to the other despite these forces. With a more flowable commodity, though, this can be a problem.

When a single bladder is used in a railcar, the bladder will tend to sway under the changes in direction and speed of the railcar. However, this does not tend to be a problem if the bladder is supported and space is provided between the bladder and the endwalls. When a series of bladders are installed in a railcar extending substantially along the entire length of the car, though, the shifting of the load can be problematic.

When a train appreciably accelerates or decelerates, the contents of the bladder at one end will flow rearwardly or forwardly, respectively, due to inertia. If this first bladder is allowed to contact another bladder, the contents of the second bladder will move not only due to inertia but also in response to the force of the first bladder acting against the second bladder and the contents of the second bladder will react more noticeably and rapidly than the contents of the first bladder. If this process is carried along a series of three or four bladders, the resultant accumulated force can be quite strong. In some circumstances, this "surge" of force could, in theory, be great enough to rip an endwall away from the rest of the car, particularly as most railcars used for hauling coal and the like do not have any direct connection between the two endwalls.

Open top gondolas and hoppers for carrying bulk commodities (e.g. coal) are not presently designed to expediently and efficiently accommodate bladders for transport. The staggered bracing configurations of such railcars outlined above can totally preclude, or at least reduce, the number and/or size of bladders which may be effectively used in the car.

At least one railcar has been designed specifically for the transport of bladders. These low-sided gondola cars have interior walls to compartmentalize the car into areas designed to snugly receive several bladders and a continuous flat floor to provide an even plane on which they will rest. These railcars are not adapted to transport coal or similar bulk commodities for use in industry-standard procedures because they do not meet the necessary volume, loading, and unloading parameters. These cars' interior wall design, to secure the bladders during transport, completely compartmentalizes the cars making this design deficient for use in coal cars. For example, when coal is flood loaded into a car at 100 tons or more per minute, it puts great stress on the walls of the car and coal must be allowed to flow throughout the volume of the car for accurate and effective loading. The braces and the center sill of current coal car designs are adapted to provide strength to the railcar structure to withstand these forces (as well as torsional and flexural stresses during transport), yet allow the coal or other such commodity to readily flow around the bracing to rapidly and easily fill the railcar.

The interior wall design of this bladder carrying railcar most likely would be unable to withstand the physical forces because the compartment walls preclude the coal from flowing throughout the car. Also, freezing of coal in railcars during winter transport is a major problem in the industry. The bladder railcars' compartments defined by these interior wills would also enhance the undesirable effect of frozen coal in the car through compartmentalization.

By their very construction, tanker cars are unsuitable for hauling anything but fluids. Similarly, open topped hopper cars are not very useful for hauling anything but granular commodities, and bladder gondolas are ill suited for transporting anything but bladders. All three types of railcars have dedicated use construction, which means such cars frequently carry loads only in one direction, resulting in high operating expenses for the railroad. These costs include fuel for transporting empty cars, and high capital costs for single purpose cars which ride the mils empty half the time. This creates a significant under-utilization of railroad equipment and capital.

Furthermore, from time to time with changes in market demands for materials and their associated railcars, there is significant oversupply or under demand for railcars with changing markets. Present car configurations provide the railroad with minimum car use flexibility to respond to these changing market dynamics during the cars' service life, which is often fifty years.

Bladders are such as those mentioned above are a desirable way to utilize railcars designed to carry a bulk commodity in one direction and carry a different material which requires containment, such as waste products including coal fly ash, biosolids (sewage sludge), municipal solid waste (MSW) or commodities such as lime or petrochemical fertilizers, on the return trip. As explained earlier, though, bladders are not readily accepted by the present configurations of most coal cars and the volume of the car which can be filled with bladders is somewhat limited. Bladders have been transported on converted flatbed/low side gondola railcars in the past, but these cars are not readily adaptable to handling coal, mineral ores and similar bulk materials.

Thus, it would be desirable to provide a railcar which can be used to haul both bulk commodities such as coal and liquids or other flowable materials. In particular, such a design would optimally permit the bladder or bladders to be readily removed from the cargo hold of the railcar so that the car may be filled, and possibly emptied at existing rates, with existing equipment through an open top, yet accommodate bladders for hauling other flowable materials.

SUMMARY

The present invention provides a railcar which can be used in hauling bulk commodities such as coal yet permits a plurality of bladders to be transported therein without the difficulties discussed above in connection with current designs. In particular, a railcar of the invention includes a plurality of braces spaced along the length of the car. The braces are desirably generally I-shaped and include a lower horizontal strut extending between the sidewalls adjacent the center sill of the car, an upper horizontal strut extending between upper portions of the sidewalls, and a vertical strut extending between the two horizontal struts. The braces provide structural support and stiffness to the railcar, permitting it to withstand the rigors of common coal loading and unloading methods.

The braces also serve to generally isolate bladders placed in the railcar from one another, essentially defining a series of bladder-receiving stalls in the interior of the railcar. This isolation will help reduce or eliminate any undue forces which may arise when bladders are in direct contact with one another, such as the chain reaction surging discussed above. Nonetheless, the braces are designed to permit coal or other similar commodities to flow relatively freely within the interior of the railcar. By using a series of struts rather than a number of walls to isolate bladders, the braces have the unique advantage of acting to define stalls for receiving bladders, but permitting coal to move freely from one stall to another.

DETAILED DESCRIPTION

FIGS. 1–5 and 8 depict a first embodiment of a railcar of the invention. The railcar 10 generally includes a floor 20, a pair of endwalls 30 and a pair of sidewalls 40. The floor may be of any desired design and optimally is selected from any of a variety of floor shapes and sizes already accepted in the coal industry, e.g. a hopper car will include a series of generally V-shaped depressions (not shown) defining hopper chutes for emptying coal or the like through openings at the bottoms of the hoppers by gravity.

Figure 1:
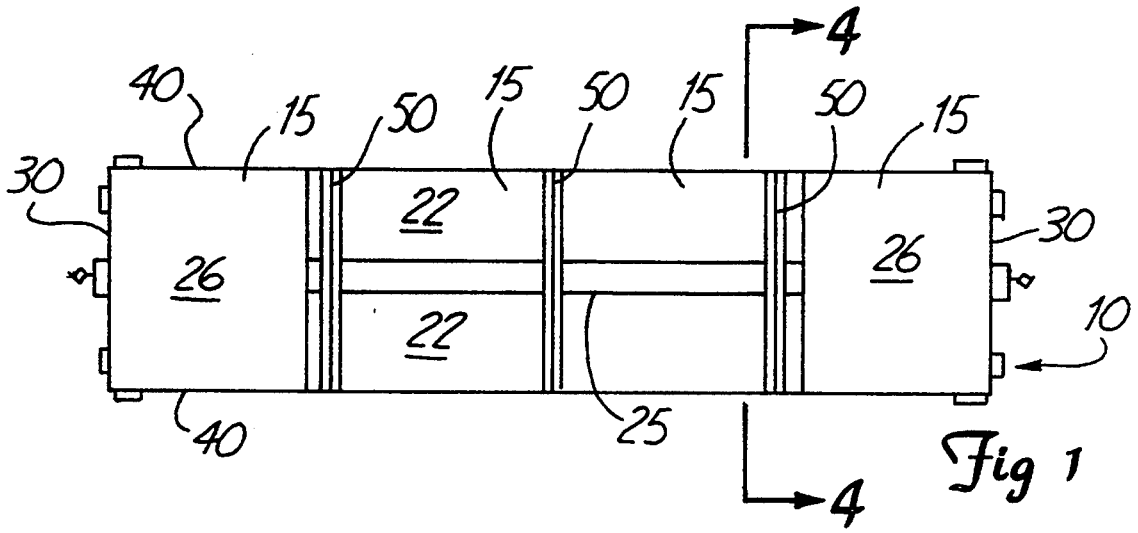
FIG. 1 is a top view of a railcar in accordance with the invention.
Figure 2:
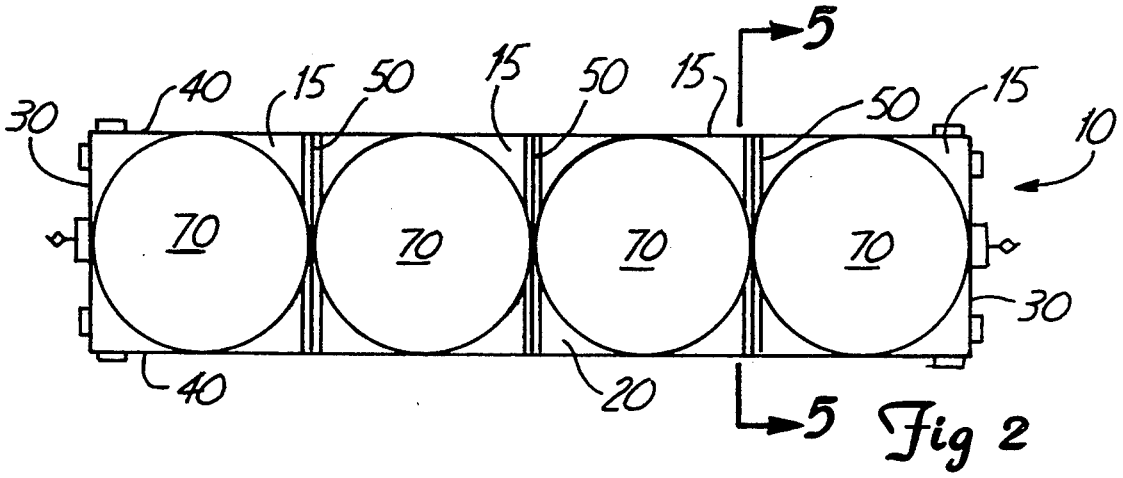
FIG. 2 is a top view of the railcar of FIG. 1 illustrating bladders disposed within the railcar.
Figure 3:
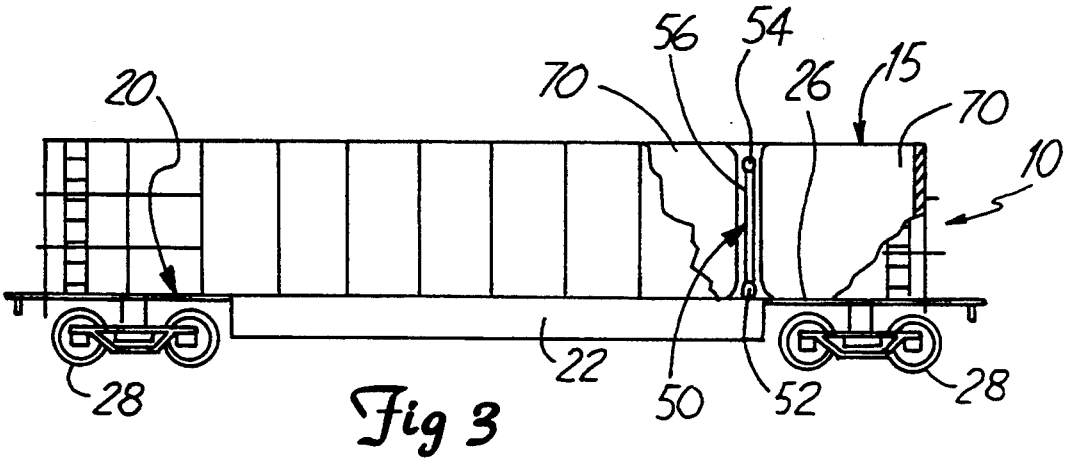
FIG. 3 is a partially broken-away side view of the railcar of FIG. 1.
Figure 4:
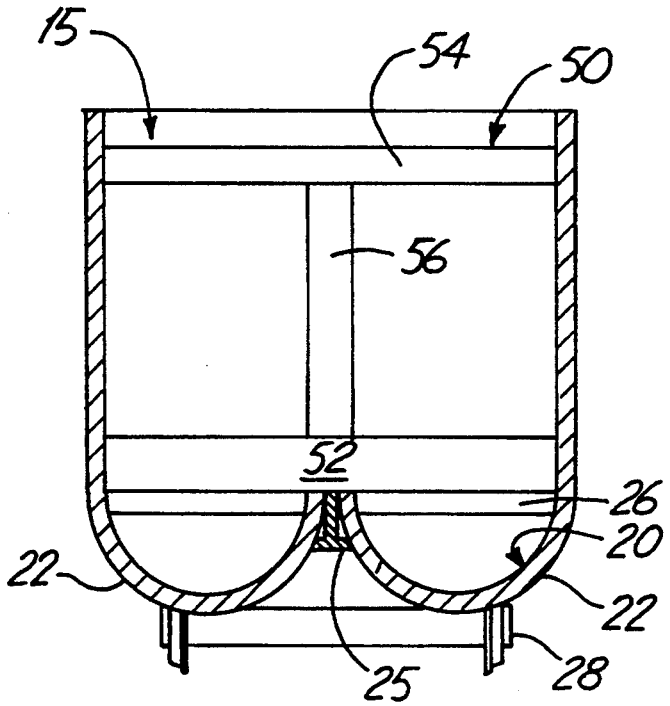
FIG. 4 is a cross sectional end view of the railcar of FIG. 1, taken along sectional line 4—4 of that figure.
Figure 5:
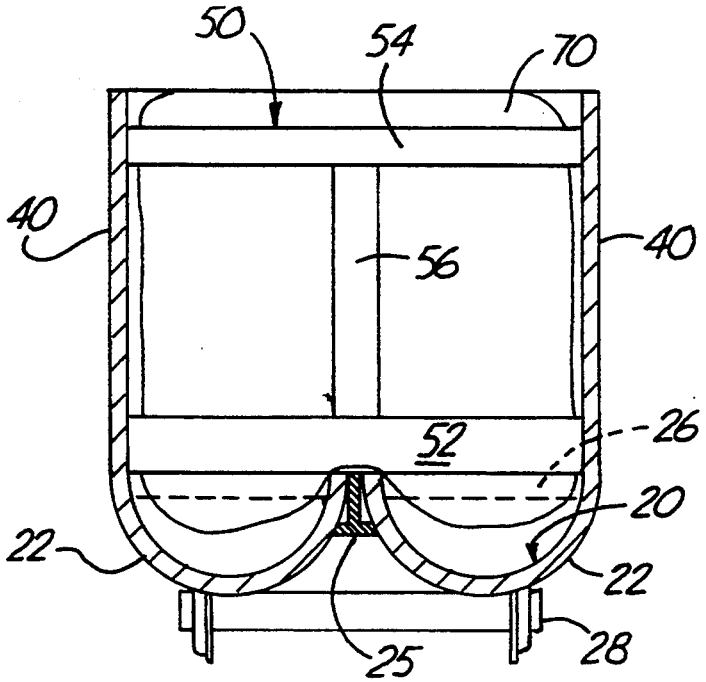
FIG. 5 is a cross sectional end view of the railcar of FIG. 2, taken along sectional line 5—5 of that figure, with a bladder disposed therein.

FIGS. 1–5 and 8, though, illustrate what is referred to in the coal industry as a "bathtub" car. In such a car, the floor comprises two elongate, generally parallel segments 22 which extend along most or all of the length of the railcar. Each segment is generally U-shaped in cross section (as best seen in FIGS. 4 and 5), not unlike a long bathtub.

In aluminum bathtub cars, a center sill 25 is disposed between these two bathtub segments 22 and also desirably extends along the length of the railcar from one endwall 30 to the other. Steel cars are generally stiff and strong enough without such center sills and usually have a smooth, low-slung floor defining a single elongate, more gently curved U-shape depression. This shape rather resembles the shape of a common bathtub, hence leading to the common name in the industry for such cars as "bathtub" cars. If a center sill is employed, though, it is generally formed of an elongate length of steel I-beam or the like.

This center sill 25 helps provide stiffness to the railcar along its length and provides structural support to the floor under the load of the coal or other materials in the car. The center sill is desirably connected to the trucks 28 upon which the cars ride along rails. This serves to absorb bending stresses as the railcar travels along curves or the like by keeping the trucks rigidly connected to one another.

Figure 8:
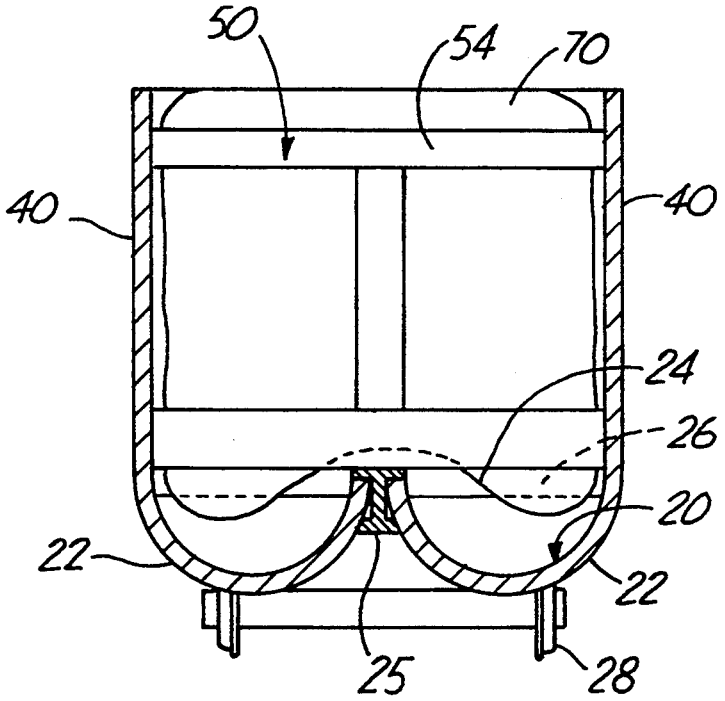
FIG. 8 is a cross sectional end view of the railcar of FIG. 5 with a bladder disposed therein and including a platform upon which the bladder may rest.

In "hopper cars", described above, the floor defines a series of discharge hoppers for unloading commodities from the railcar through the floor. In such a design, each of the bladders should be adapted to rest on the center sill, which will commonly extend between adjacent V-shaped hopper depressions in the floor. U.S. patent application Ser. No. 08/067,464, attorney's docket no. 18355.1.14, entitled "Railroad Car Conversion Apparatus and Support Therefor", filed the same day as the present application and in the name of the inventor of the present invention (the teachings of which are incorporated herein by reference), teaches a platform upon which the bladders can rest. As illustrated in FIG. 8, this platform 24 is adapted to rest on the center sill, with the center sill being received within a notch in the bottom of the platform. The platform provides a more stable load than if the bladders rest directly on the center sill as they will tend to sag around the sill, as illustrated in FIG. 4.

In bathtub cars, such as the car illustrated in FIGS. 1–5, the "bathtub" configuration of the floor described above will generally extend only between the two trucks, dipping below the level of the tops of the trucks to maximize volume of the interior of the car. As these railcars are usually of the "rotary dump" variety and are essentially turned upside down to be emptied through their tops, there is no need to provide hoppers in the floor for discharging the contents of the car.

In most such cars, the center sill only extends between the trucks, with the floors of the cars extending between a location over a truck and the adjacent endwall frequently being slanted upwardly away from the center of the car. If so desired, the bladders resting on the center sill of the car may be provided with a platform 24, as noted above. If the portions of the floor adjacent the ends of the car are sloped, though, this will tend to limit the utility of the last two stalls of the interior of the car as the floor will not support the large, heavy bladders very well and it may not be commercially feasible to haul bladders in those stalls at all. Accordingly, the end portions 26 of the floors of bathtub cars of the invention, which are generally those portions of the floor which extend between a location over a truck and the nearest endwall 30, are desirably generally horizontal, with the level of the floor being generally horizontally aligned with the top of the center sill.

The endwalls and sidewalls (30 and 40, respectively) are optimally substantially flat and substantially vertically oriented, meeting the floor at about a 90° angle, to maximize the volume of the railcar within the length and height limitations placed on railcars in the industry. In most standard railcar designs, railcars are significantly longer than they are wide, so the sidewalls 40 are preferably longer than the endwalls are wide, as illustrated in the drawings.

Railcars 10 of the invention also include a plurality of braces 50 spaced along their length. As best seen in FIG. 4, the braces include a lower horizontal strut 52, an upper horizontal strut 54 and a generally vertical strut 56 extending between the two generally horizontal struts 52,54. The lower horizontal strut 52 of each brace 50 is desirably rigidly secured to the center sill adjacent the middle of the strut and extends between and is rigidly secured to the two sidewalls 40 of the railcar at its opposed ends. The strut 52 may be attached to the center sill and the sidewalls in any useful fashion, such as by welding or by means of bolts or rivets.

FIG. 4 illustrates the lower horizontal strut as extending upwardly above the top of the center sill. It is to be understood, however, that this strut could be lower so that the center sill extends through a portion of the strut. Alternatively, though less desirably, it could be raised up above position shown in FIG. 4 such that it is positioned above the center sill, with the vertical strut 56 extending between the lower strut 52 and the center sill.

The upper horizontal strut 54 may be substantially the same as the lower horizontal strut 52 in construction. Whereas the lower horizontal strut extends between the sidewalls closer to their lower edges, though, the upper strut 54 will extend between the sidewalls closer to their respective top edges. If so desired, the upper struts may be positioned immediately adjacent the tops of the sidewalls. However, in the embodiment illustrated in the drawings, the upper strut 54 is spaced below the top edges of the sidewalls.

As best seen in FIG. 5, current commercially available bladders 70 have curved, dome-like tops. Accordingly, when a series of bladders are positioned side-by-side, their tops will not abut one another. Instead, the bladders will contact one another along their generally cylindrical bodies. The upper strut is advantageously positioned at a height approximately equal to the uppermost point of contact between adjacent bladders if the braces 50 were not in place. When the bladders shift during transport, the upper strut will therefore serve to limit the contact between the bladders adjacent their tops.

The braces 50 of the embodiment of the invention shown in FIGS. 1–5 and 8 also include a single generally vertical strut 56 which extends between and connects the generally horizontal struts 52, 54. The vertical strut is optimally rigidly attached to the horizontal struts adjacent the middle of their respective lengths. The vertical strut can be welded directly to the horizontal struts. If so desired, the vertical strut 56 can be attached to the center sill as well in order to provide even greater strength and rigidity to the brace 50. This will also serve to transfer forces acting against the brace to the stiff center sill and the help rigidly support the sidewalls 40.

Figure 6:
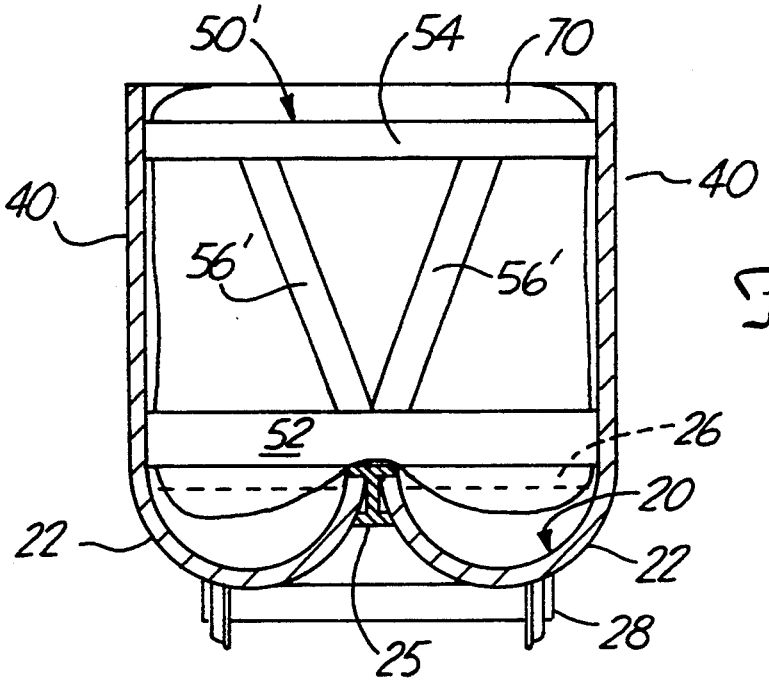
FIG. 6 is a cross sectional end view of an alternative embodiment a railcar of the invention.

FIG. 6 illustrates an alternative embodiment of a brace in accordance with the invention. In this embodiment, the generally horizontal struts 52 and 54 remain substantially the same as in the embodiment illustrated in FIGS. 1–5 and 8 and described above. Whereas the embodiment described above in connection with those drawings uses only a single generally vertical strut 56, the brace 50' of the embodiment of FIG. 6 uses a pair of divergent struts 56'. The divergent struts 56' are generally vertically oriented, but diverge away from one another upwardly toward the upper horizontal strut 54.

The divergent vertical struts 56' form a narrow V-shape, with the bottoms of the struts being rigidly secured (e.g. by welding) to the lower horizontal strut 52 and, desirably, to one another as well. The upper ends of the struts 56' are rigidly secured to the upper horizontal strut 54. Although the struts 56' do diverge away from one another to define a gap therebetween adjacent the upper strut 54, it is preferred that the struts not diverge away from one another too far. If the upper ends of the struts 56' were spaced too far apart, this might enable a portion of the flexible bladders to squeeze between the struts under pressure and come into direct contact with one another.

As explained below in connection with the prior art railcar design shown in FIG. 7, allowing the bladders to forcibly urge against one another can lead to significant problems during transport. By keeping the upper ends of the divergent vertical struts 56' relatively close to one another, the bladders can be separated sufficiently to prevent them from forcibly bumping into one another and creating a chain reaction surge if the train is forced to come to a relatively rapid halt.

The braces 50 or 50' should be spaced along the length of the railcar to define a series of spaces therebetween sized to comfortably receive a bladder 70 therein. In most railcars used in hauling coal and the like, the railcar is long enough to comfortably carry four bladders. In conjunction with the sidewalls 40 and endwalls 30 four bladder-receiving stalls 15 can be provided with three braces, as illustrated in FIGS. 1–4.

If differently sized bladders or railcars are made having different dimensions, though, the number of braces and stalls defined thereby can be changed. For instance, a railcar adapted to receive three bladders rather than four (not shown) would utilize only two braces 50, but the shape and structure of the braces would desirably be substantially as outlined above.

The size of the stalls 15 and the size of the bladders should be selected to provide an optimum fit of the bladders in the stalls consonant with the maximization of the volume of material haulable in a load of bladders. The bladders are optimally received relatively snugly within the stalls, but care should be taken that the stalls are not too small for the bladders as this will cause undue wear on the bladders as they are loaded into the cars and as they are jostled during transport.

It is also preferred that the stalls all be approximately equal in size so a single, standardized size of bladder can be used interchangeably in all of the stalls. This not only greatly simplifies handling ease of the bladders, but also permits standard-shaped bladder to be used rather than requiring a series of specially shaped bladders which must often be formed by hand. Using standard bladders reduces cost both in terms of economy of scale and in light of the fact that specially shaped bladders tend to be a little bit weaker and will not last as long as standard, generally cylindrical bladders.

Utilizing the braces of the invention helps provide necessary structural support to the railcar for hauling bulk commodities such as coal. Having the horizontal struts 52,54 extend between the sidewalls 40 helps support the sidewalls when coal is "floodloaded" at high flow rates, but the braces do not have a very high surface area. This provides the railcar 10 of the invention with necessary structural strength without significantly impeding the flow of coal or like goods in the interior of the railcar during filling or emptying operations.

Other bracing systems know in the art provide structural support to railcars to enable the cars to withstand the rigors of repeated loading and unloading operations. However, the braces 50 of the invention have the unique advantage of also serving to effectively separate bladders from one another and to absorb the forces generated by the bladders as they shift during transport.

Figure 7:
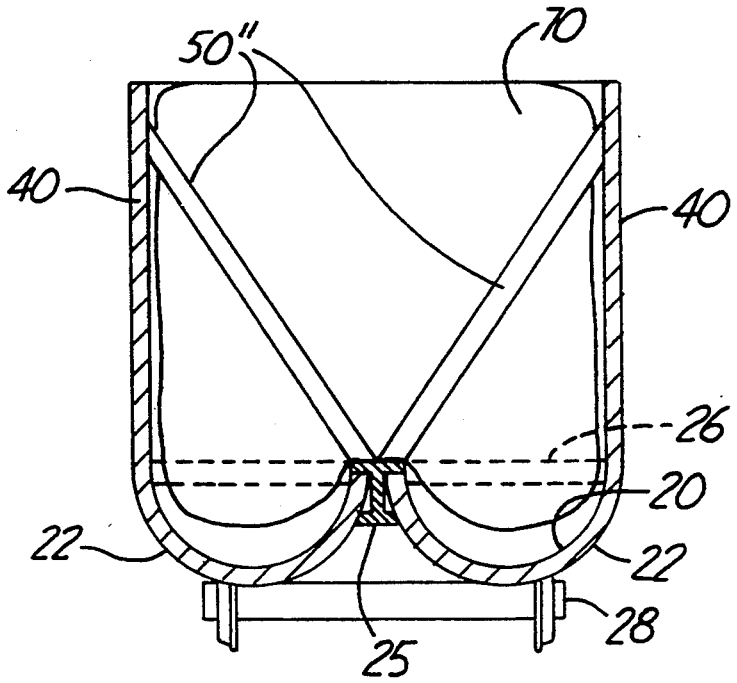
Fig. 7 PRIOR ART
FIG. 7 is a cross sectional end view of a standard railcar employing a generally V-shaped brace and having a bladder therein.

FIG. 7 illustrates one type of interior bracing 50'' used in current railcars. In such a railcar, the V-shaped braces provide structural support to the sidewalls 40'' and make the car more rigid. Although this permits the cars to be used to haul coal fairly readily, the braces are most often poorly suited to receive a number of commercially available bladders because they are not optimally spaced to define good bladder-receiving areas. Even if they were properly spaced, though, the braces would be disposed between adjacent bladders.

The V-shaped braces of the prior art may limit contact between the bottoms of adjacent bladders as the lower portion of the V's will interfere with direct contact between the bladders. However, the struts of the V-shaped braces diverge away from one another toward the top of the railcar. As they diverge, they allow space through which adjacent bladders may extend and abut one another.

If the railcar experiences significant changes in velocity during transport, the contents of the flexible bladders will tend to flow under the impetus of inertia. Since the braces 50'' allow the upper portions of the bladders to come into to contact with one another, the movement of the contents of the first bladder will be transferred to the second bladder, which will transfer both the force of its own contents' shifting and the force of the next bladder. By the time all of this accumulated force reaches the endwall of the railcar, the chain reaction can be strong enough to cause significant structural damage to the railcar. In an extreme circumstance, this could even rapture an endwall of the car or cause a "ran-in", a chain reaction along the length of a train which can lead to derailment of the entire train.

Braces 50 and 50' of the invention, though, maintain a structural impediment between adjacent bladders and limit this chain reaction. As the bodies of the bladders tend to be relatively cylindrical, the horizontal struts 52,54 will tend to contact the walls of the bladders generally tangentially. The vertical strut 56 will tend to be disposed along a walls of two adjacent bladders, serving to separate the bladders from one another.

If a railcar 10 of the invention experiences sudden acceleration or deceleration, the contents of the bladders will still tend to flow. However, the bladders will tend to be forced up against a brace 50 rather than against one another. The brace 50 is preferably rigidly secured to the walls of the railcar and the center sill, as noted above, so the brace 50 is able to absorb the force of the bladder acting against it. In this manner, the chain reaction of surging through the length of the railcar is avoided, preserving the structural integrity of the railcar.

The vertical strut 56 of the invention need not be wide enough to prevent any and all contact between bladders. It is contemplated that, in an extreme circumstance, the flexible bladders may be urged to flow slightly around the vertical strut and one bladder may contact the next. However, the presence of the vertical strut will help minimize any forces that could be transferred from one bladder to the next.

The upper horizontal strut 54 helps prevent the tops of the bladders from shifting too far and coming into contact with one another. As the endwalls of the railcars tend to be weakest adjacent their tops, the upper horizontal struts help avoid a chain reaction which could strike a rather forceful blow against the weaker top of the endwall. The braces of the invention, therefore, can help greatly decrease the stress on railcars carrying bladders filled with flowable material as compared to the V-shaped braces described above or any other prior art bracing system designed solely for transport bulk material.

The braces 50 of the invention should be made of a strong, relatively rigid material which is capable of withstanding the forces encountered during use. For instance, the braces of the invention can be made of steel, aluminum, or any other suitable metal. In the past, most railcars were made of heavy steel, but newer railcars tend to be made of aluminum, which is significantly lighter. If so desired, steel braces can be used in steel railcars and aluminum braces can be used with aluminum railcars in order to avoid any corrosion that may occur if dissimilar metals are used in direct contact with one another.

The present specification sets forth a railcar in accordance with the present invention. Such a railcar can be manufactured from the very beginning in accordance with the present invention, but it need not be so made. Current railcars are "rebuilt" on a routine basis in order to extend their useful lives. During this process, the structure of the car is overhauled, often quite extensively. A railcar could easily be modified from an existing design to a design of the present invention during such rebuilding.

Also, it may be relatively simple to convert some standard coal car designs to comply with this invention by a simple retrofitting process without necessitating a complete rebuilding. In such a retrofitting, existing braces can be cut out of the car and replaced with braces in accordance with the invention. This would avoid any significant downtime for the railcar, allowing an entire fleet of some railcars to be quickly and relatively cheaply converted for use according to this invention without greatly inconveniencing the railroad operator or its customers.

While a preferred embodiment of the present invention has been described, it should be understood that various changes, adaptations and modifications may be made therein without departing from the spirit of the invention and the scope of the appended claims.

What is claimed is:

1. A railcar for use in hauling both bulk commodities and bladders, comprising a floor, a pair of opposed endwalls, a pair of opposed sidewalls, and a brace comprising a lower horizontal strut having opposed ends and being connected to a lower portion of one sidewall on one end and a lower portion of the other sidewall on the other end, an upper horizontal strut having opposed ends and being connected to an upper portion of one sidewall on one end and an upper portion of the other sidewall on the other end, and a generally vertical strut extending between and connected to the upper horizontal strut and the lower horizontal strut, wherein the brace is positioned between the endwalls at an intermediate point along the length of the railcar to define stalls for receiving the bladders, the brace being capable of restricting the movement of the bladders and permitting bulk materials to move freely from one stall to another.

2. The railcar of claim 1 wherein the vertical strut is connected to each horizontal strut adjacent the middle of the horizontal strut.

3. The railcar of claim 1 further comprising a center sill extending along and structurally supporting the floor.

4. The railcar of claim 3 wherein the center sill extends through a portion of the lower horizontal strut.

5. The railcar of claim 1 wherein a plurality of said braces are positioned at intermediate points along the length of the railcar, the braces being spaced approximately equidistant from each other and the endwalls to define a plurality of stalls having approximately the same size.

* * * * *